US007532839B2

(12) United States Patent
Ishii

(10) Patent No.: US 7,532,839 B2
(45) Date of Patent: May 12, 2009

(54) PROCESS CARTRIDGE WITH A FRAME THAT SUPPORTS AN IMAGE HOLDING MEMBER AND AN IMAGE FORMING APPARATUS

(75) Inventor: Makoto Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/087,032

(22) Filed: Mar. 23, 2005

(65) Prior Publication Data

US 2005/0220482 A1 Oct. 6, 2005

(30) Foreign Application Priority Data

Mar. 31, 2004 (JP) ..... 2004-107321

(51) Int. Cl.
*G03G 21/16* (2006.01)

(52) U.S. Cl. ..... 399/111; 399/113; 399/262

(58) Field of Classification Search ..... 399/111, 399/112, 113, 114, 262; 222/DIG. 1
See application file for complete search history.

(56) References Cited

U.S. PATENT DOCUMENTS

| | | | | |
|---|---|---|---|---|
| 4,989,037 | A * | 1/1991 | Nagatsuna | |
| 5,061,959 | A * | 10/1991 | Kinoshita et al. | 399/113 |
| 5,347,343 | A * | 9/1994 | Ohtsuka et al. | 399/111 |
| 5,371,575 | A * | 12/1994 | Sekino et al. | 399/113 |
| 5,488,459 | A | 1/1996 | Tsuda et al. | |
| 5,854,955 | A * | 12/1998 | Yawata et al. | 399/111 |
| 5,878,310 | A | 3/1999 | Noda et al. | |
| 5,943,528 | A | 8/1999 | Akutsu et al. | |
| 6,072,969 | A * | 6/2000 | Yokomori et al. | 399/262 |
| 6,594,459 | B2 * | 7/2003 | Kamano et al. | 399/113 |
| 6,674,982 | B2 | 1/2004 | Saitoh et al. | |
| 6,832,061 | B2 * | 12/2004 | Saito et al. | 399/111 |
| 6,928,252 | B2 | 8/2005 | Takami et al. | |
| 6,937,834 | B2 * | 8/2005 | Kanno et al. | 399/114 |
| 7,082,274 | B2 | 7/2006 | Saitoh et al. | |
| 2003/0185588 | A1 | 10/2003 | Takami et al. | |
| 2005/0207784 | A1 * | 9/2005 | Inaba | 399/113 |

FOREIGN PATENT DOCUMENTS

| | | |
|---|---|---|
| EP | 0 577 404 A | 1/1994 |
| EP | 0 577 404 A1 | 1/1994 |
| EP | 0 740 227 A | 10/1996 |
| EP | 0 740 227 A1 | 10/1996 |
| EP | 0 753 800 A | 1/1997 |
| EP | 0 753 800 A2 | 1/1997 |
| JP | A 10-116014 | 5/1998 |
| JP | A 2001-100550 | 4/2001 |
| JP | A 2002-108170 | 4/2002 |
| JP | A 2002-162865 | 6/2002 |
| JP | A 2003-76249 | 3/2003 |
| JP | A 2003-295720 | 10/2003 |
| JP | A-2003-295720 | 10/2003 |

* cited by examiner

*Primary Examiner*—David M Gray
*Assistant Examiner*—Laura K Roth
(74) *Attorney, Agent, or Firm*—Oliff & Berridge, PLC

(57) ABSTRACT

A process cartridge includes an image holding member that is capable of holding a developing agent image thereon, a shaft that supports the image holding member, a bearing portion that receives the shaft, a charging device that is capable of charging the image holding member, and a first frame that supports the bearing portion and the charging device.

24 Claims, 10 Drawing Sheets

PROCESS CARTRIDGE WITH A FRAME THAT SUPPORTS AN IMAGE HOLDING MEMBER AND AN IMAGE FORMING APPARATUS

CROSS REFERENCE TO RELATED APPLICATIONS

This application claims priority from Japanese Patent Application No. 2004-107321, filed Mar. 31, 2004. The entire subject matter of which is incorporated herein by reference hereto.

BACKGROUND

The disclosure relates to a process cartridge that is capable of being used with an image forming apparatus.

Process cartridges are used in image forming apparatuses (i.e., laser printers). Conventionally, the process cartridge includes a charger, a developing cartridge, and a transfer roller disposed around a photosensitive drum. Upon rotation of the photosensitive drum, a surface of the photosensitive drum is uniformly charged by the charger, and is then selectively exposed to light by a laser beam. This process partially removes electrical charges from the surface of the photosensitive drum in order to form an electrostatic latent image on the surface of the photosensitive drum. The electrostatic latent image on the surface of the photosensitive drum is developed into a toner image by supplying toner from the developing cartridge when the electrostatic latent image faces the developing cartridge. The toner image carried on the surface of the photosensitive drum faces the transfer roller, and when a sheet passes between the photosensitive drum and the transfer roller, the toner image is transferred to the sheet.

Japanese Laid-Open Patent Publication No. 2003-295720 discloses a process cartridge having a drum frame which is divided into an upper frame and a lower frame. In this process cartridge, the upper frame supports the charger and the lower frame supports the photosensitive drum, the developing cartridge, and the transfer roller. When the upper frame and the lower frame are assembled, the charger faces the photosensitive drum at a specified distance at an upper portion of the photosensitive drum.

SUMMARY

To uniformly charge the surface of the photosensitive drum, a positional relationship (a distance) between the photosensitive drum and the charger is important. However, in the structure described in the above disclosure, the upper frame and the lower frame determine the relative position between the photosensitive drum and the charger. It is thus difficult to accurately determine the relative position between the photosensitive drum and the charger. That is, because the upper frame and the lower frame have respective manufacturing errors, when the upper frame and the lower frame are assembled, the relative position between the upper frame and the lower frame is weighted with the respective manufacturing errors of the upper frame and the lower frame. As a result, it becomes difficult to accurately determine the relative position between the photosensitive drum and the charger due to the manufacturing errors.

If a large error occurs in the relative position between the photosensitive drum and the charger, accurate uniform charging of the surface of the photosensitive drum will deteriorate, and the quality of an image formed on the sheet will also deteriorate.

The disclosure thus provides, among other things, a process cartridge capable of accurately determining a relative position between an image holding member and a charging device, and an image forming apparatus that is capable of using the process cartridge in order to form high-quality images.

In exemplary embodiments, a process cartridge may include an image holding member that is capable of holding a developing agent image thereon; a shaft that supports the image holding member; a bearing portion that receives the shaft; a charging device that is capable of charging the image holding member; and a first frame that supports the bearing portion and the charging device.

In exemplary embodiments, a process cartridge may include an image holding member that is capable of holding a developing agent image thereon; a shaft that supports the image holding member; a bearing portion that receives the shaft; a plurality of processing devices, each processing device capable of conducting a specified operation with respect to the image holding member; a first frame that supports the bearing portion and at least one of the plurality of processing devices; and a second frame that supports the bearing portion when the first frame is assembled with the second frame and at least one of the plurality of processing devices except for the at least one of the plurality of processing devices supported by the first frame.

In exemplary embodiments, a process cartridge may include an image holding member that is capable of holding a developing agent image thereon; a shaft that supports the image holding member; a first frame that supports the shaft; and a second frame positioned with reference to the shaft when the second frame is assembled with the first frame.

In exemplary embodiments, a process cartridge may include a first frame, an image holding member rotatably provided at the first frame, a bearing member provided at the first frame, a shaft that supports the image holding member, the shaft being supported by the bearing member, and a second frame having a receiving portion that is capable of receiving the bearing member.

BRIEF DESCRIPTION OF THE DRAWINGS

An embodiment of the disclosure will be described in detail with reference to the following figures wherein.

DETAILED DESCRIPTION OF EMBODIMENTS

Figure 1:
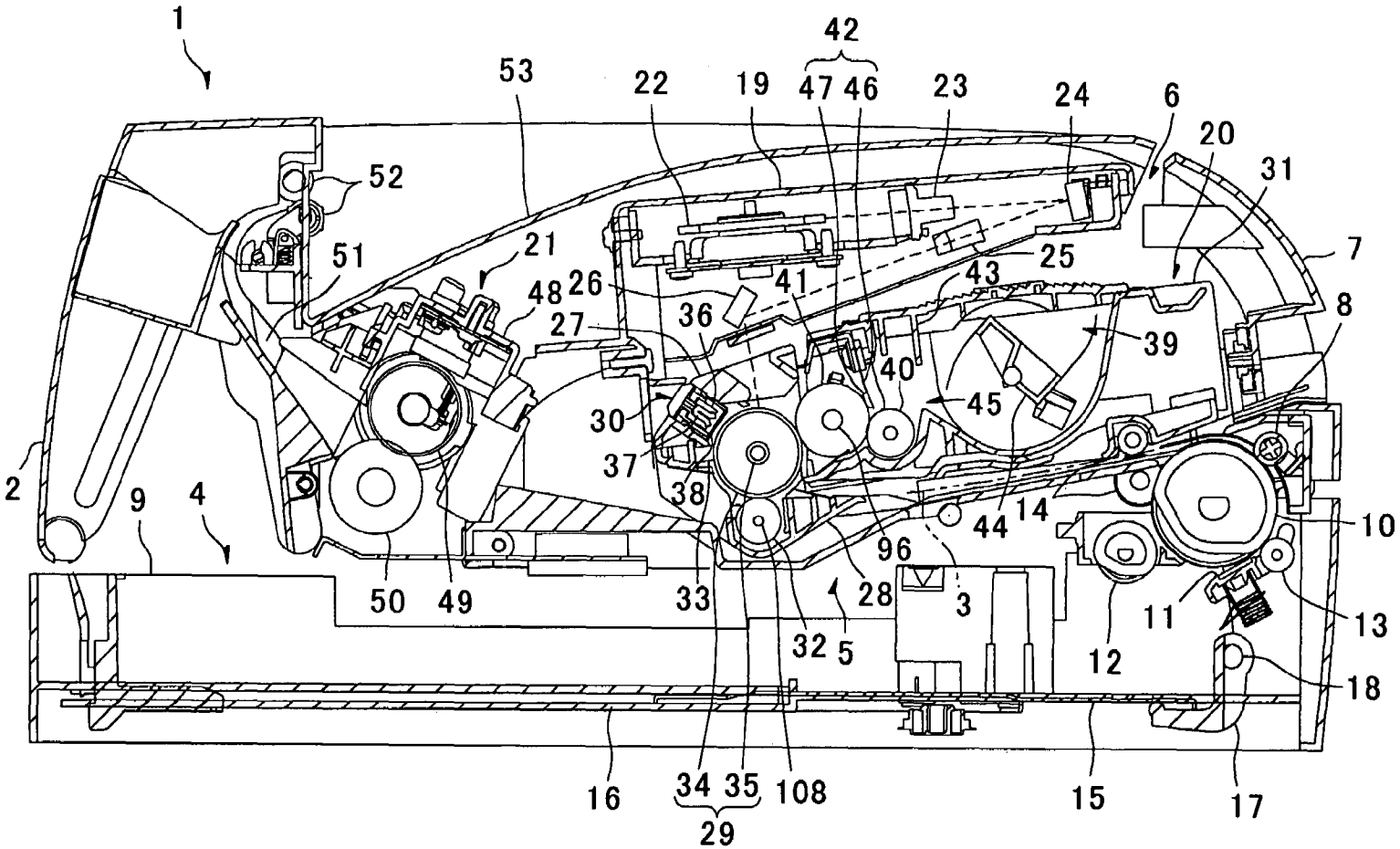
FIG. 1 is a sectional view of essential parts of a laser printer as an image forming apparatus of an embodiment of the disclosure when a front cover is closed.

An embodiment of the disclosure will be described in detail with reference to the accompanying drawings. As shown in FIG. 1, a laser printer 1 includes, in a main casing 2, a feeder unit 4 that supplies a sheet 3 as a transfer medium, and an image forming part 5 that forms an image on a sheet 3 supplied therein.

Figure 2:
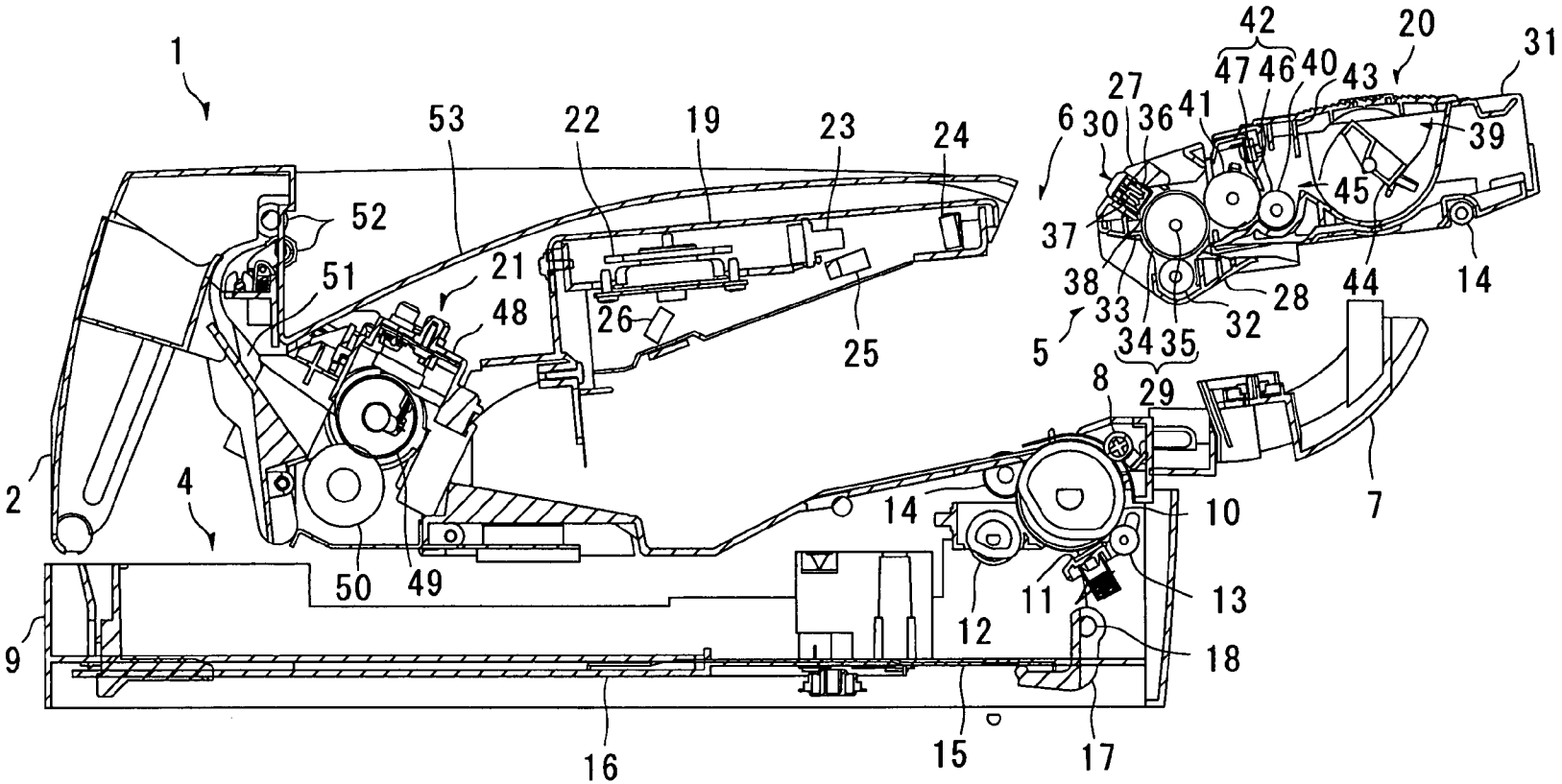
FIG. 2 is a sectional view of the essential parts of the laser printer shown in FIG. 1 when the front cover is open.

The main casing 2 is formed with an opening 6 through which a process cartridge 20 is inserted in or removed from the main casing 2 and a front cover 7 capable of opening and closing the opening 6. The front cover 7 is pivotally supported by a cover shaft (not shown), which is inserted into the front cover 7 at a lower end portion thereof. When the front cover 7 is closed around the cover shaft, the opening 6 is closed by the front cover 7 as shown in FIG. 1. When the front cover is opened (tilted) around the cover shaft, the opening 6 is opened by the front cover 7 as shown in FIG. 2, so that the process cartridge 20 can be inserted into or removed from the main casing 2 via the opening 6.

In the following description, when the process cartridge 20 is mounted in the main casing 2, the side on which the front cover 7 is provided will be referred to as the front side of the laser printer 1, and the side opposite of the front side will be referred to as the rear side.

The feeder unit 4 includes, at a bottom portion in the main casing 2, a sheet supply tray 9, a sheet supply roller 10, a sheet supply pad 11, a pickup roller 12, a pinch roller 13, a paper dust removing roller 8, and resist rollers 14. The sheet supply tray 9 is removably attached. The sheet supply roller 10 and the sheet supply pad 11 are provided at an upper portion of the front end portion of the sheet supply tray 9. The pickup roller 12 is provided at a rear side of the sheet supply roller 10. The pinch roller 13 is disposed facing the sheet supply roller 10 at a lower front side thereof. The paper dust removing roller 8 is disposed facing the sheet supply roller 10 at an upper front side thereof. The resist rollers 14 are provided at an upper rear side of the sheet supply roller 10.

Inside the sheet supply tray 9, there is provided a sheet pressing plate 15 capable of holding sheets 3 in layers. The sheet pressing plate 15 is pivotally supported at its rear end. The sheet pressing plate 15 is vertically movable at its front end between a loading position and a conveying position. When in the loading position, the sheet pressing plate 15 is disposed such that its front end is positioned down and aligned with a bottom plate 16 of the sheet supply tray 9. When in the conveying position, the sheet pressing plate 15 is disposed such that its front end is inclined upward.

A lever 17 for raising the front end of the sheet pressing plate 15 is provided at a front end portion of the sheet supply tray 9. The lever 17 is formed in such a substantially L-shape in a sectional view that extends from the front side of the sheet pressing plate 15 to the underside thereof. The lever 17 is attached, at its upper end, to a lever shaft 18 provided at the front end portion of the sheet supply tray 9, and makes contact with the underside of the front end of the sheet pressing plate 15 at its rear end. When a clockwise (with respect to the drawing) rotation force is transmitted to the lever shaft 18, the lever 17 is rotated around the lever shaft 18 to raise the front end of the sheet pressing plate 15 by its rear end to the conveying position.

When the sheet pressing plate 15 is located at the conveying position, a sheet 3 on the sheet pressing plate 15 is pressed by the pickup roller 12, and is conveyed between the sheet supply roller 10 and the sheet supply pad 11 upon rotation of the pickup roller 12.

On the other hand, when the sheet supply tray 9 is removed from the main casing 2, the sheet pressing plate 15 is moved down at its front end portion by its weight, and is located in the loading position. When the sheet pressing plate 15 is located in the loading position, it is capable of loading sheets 3 thereon in layers.

An uppermost sheet 3 is forwarded by the pickup roller 12 to the sheet supply roller 10 and the sheet supply pad 11, is sandwiched between the sheet supply roller 10 and the sheet supply pad 11 upon the rotation of the sheet supply roller 10, and is then reliably supplied, one by one, separately from the stack of the sheets 3. The supplied sheet 3 passes between the sheet supply roller 10 and the pinch roller 13, where paper dust is removed by the paper dust removing roller 8, and is conveyed to the resist rollers 14. The resist rollers 14 are paired and feed a sheet 3 to a transfer position between a photosensitive drum 29 and the transfer roller 32 where toner image on the photosensitive drum 29 is transferred onto the sheet 3.

The image forming part 5 includes a scanner unit 19, the process cartridge 20, and a fixing part 21.

The scanner unit 19 is disposed at an upper portion in the main casing 2. The scanner unit 19 includes a laser light source (not shown), a polygon mirror 22 that is driven and rotated, an fθ lens 23, a reflecting mirror 24, a lens 25, and a reflecting mirror 26. In the scanner unit 19, as shown in a chain line, a laser beam emitted from the laser light source, based on print data, is deflected by the polygon mirror 22, passes through the fθ lens 23, is folded by the reflecting mirror 24, passes through the lens 25, is bent downward by the reflecting mirror 26, and then directed to a surface of a photosensitive drum 29 of the process cartridge 20.

Figure 6:
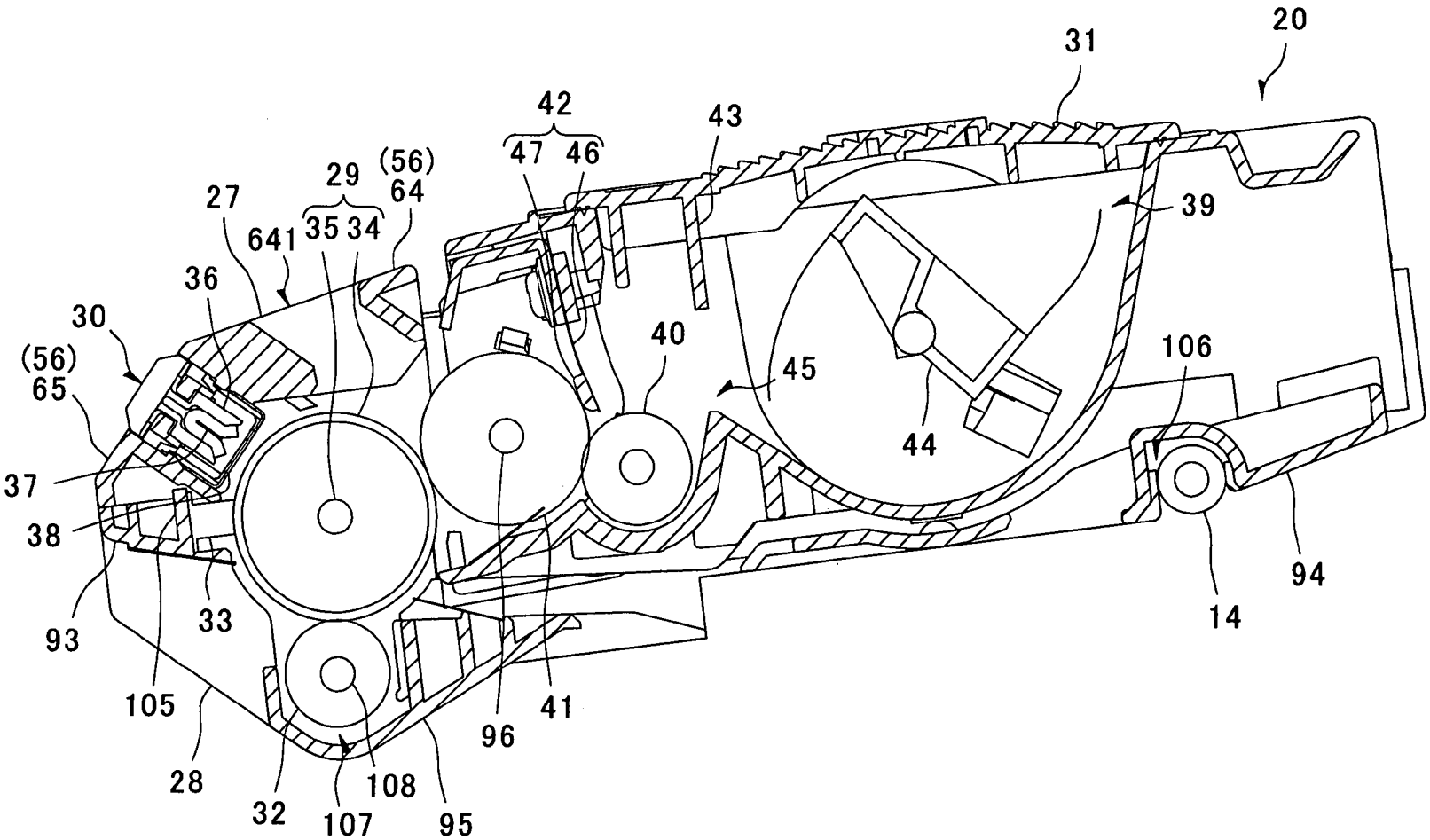
FIG. 6 is a sectional view taken along the line II-II of FIG. 3.
Figure 10:
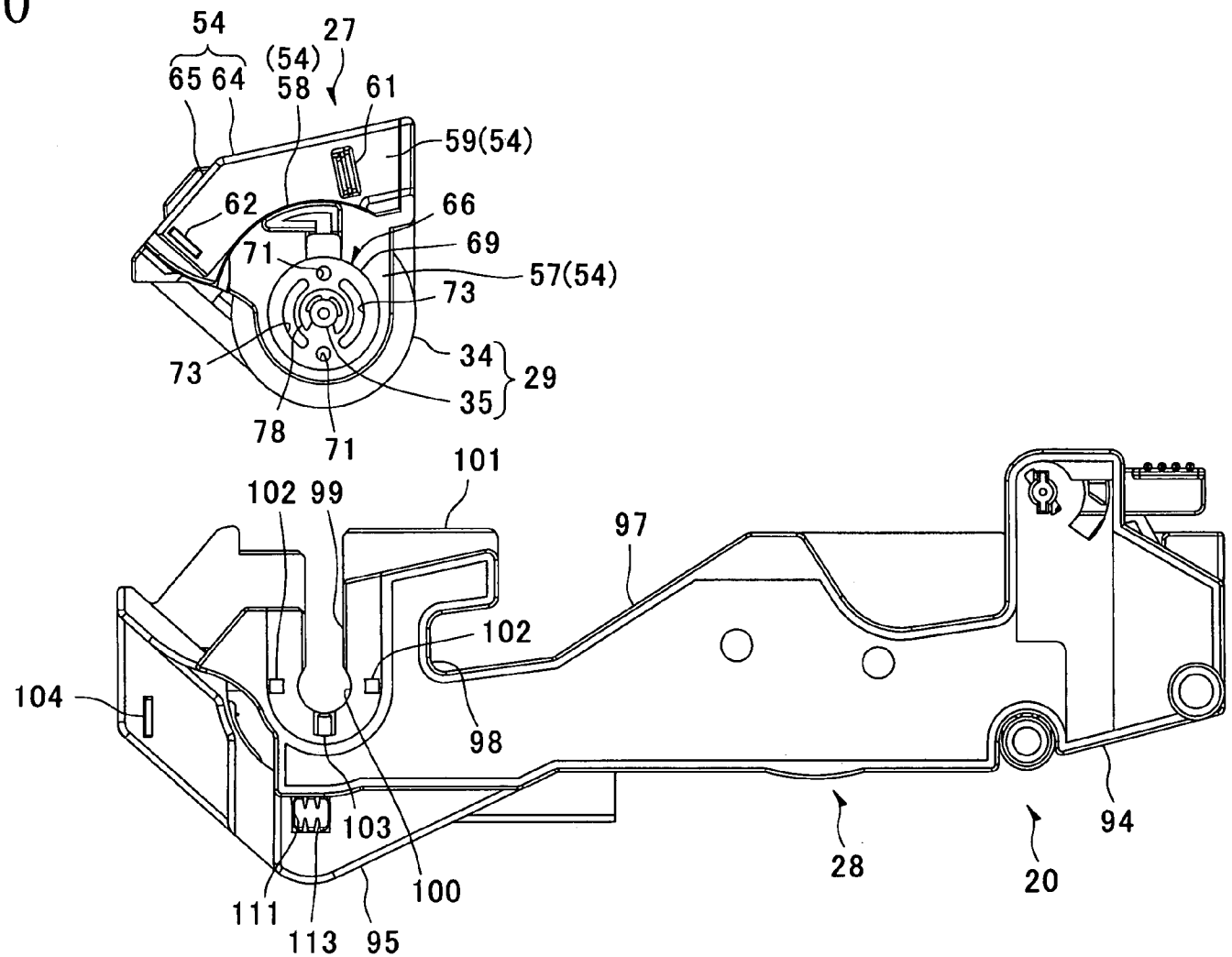
FIG. 10 is a side view showing an upper frame and a lower frame, which are shown in FIG. 4, separated from each other.

The process cartridge 20 is mounted to the main casing 2 below the scanner unit 19. The process cartridge 20 is provided with an upper frame 27 and a lower frame 28 as shown in FIG. 10. The process cartridge 20 includes the photosensitive drum 29 (functioning as an image holding member), a scorotron charger 30 (functioning as a charging device), a developing cartridge 31, a transfer roller 32 (functioning as a transfer device), and a cleaning brush 33, as shown in FIG. 6.

The photosensitive drum 29, having a cylindrical shape, is provided with a drum body 34, and a metallic drum shaft 35. The drum body 34 is formed such that its outermost layer is a positively charged photosensitive layer made of polycarbonate. The drum shaft 35 extends in a longitudinal direction of the drum body 34. The drum shaft 35 is supported by the upper frame 27, and the drum body 34 is rotatably supported by the drum shaft 35. With this structure, the photosensitive drum 29 is provided such as to rotate around the drum shaft 35 in the upper frame 27.

The scorotron charger 30 is supported in the upper frame 27, and disposed facing the photosensitive drum 29 at a specified distance so as not to contact the photosensitive drum 29. The scorotron charger 30 includes a discharge wire 37 and a grid 38. The discharge wire 37 is disposed facing the photosensitive drum 29 at a specified distance in an axial direction thereof. The grid 38 is provided between the discharge wire 37 and the photosensitive drum 29 to control a discharge amount from the discharge wire 37 to the photosensitive drum 29. The scorotron charger 30 applies a bias voltage to the grid 38 as well as a high voltage to the discharge wire 37, so that a corona discharge is generated from the discharge wire 37, and the surface of the photosensitive drum 29 is uniformly, positively charged. The scorotron charger 30 is also provided with a cleaning member 36 for cleaning the discharge wire 37, which is disposed so as to hold the discharge wire 37.

The developing cartridge 31 has a box shape and can be released via the rear side. The developing cartridge 31 is mounted to the lower frame 28. In the developing cartridge 31, a toner chamber 39, a supply roller 40, a developing roller 41, and a layer-thickness regulating blade 42 are provided.

The toner chamber 39 is formed as an internal space at the front side of the developing cartridge 31 and partitioned by a partition plate 43. The toner chamber 39 contains positively charged nonmagnetic single-component toner as a developing agent. The toner used in this embodiment is a polymerized toner obtained through copolymerization of styrene-based monomers, such as styrene, and acryl-based monomers, such as acrylic acid, alkyl (C1-C4) acrylate, and alkyl (C1-C4) methacrylate, using a known polymerization method, such as suspension polymerization. The particle shape of such a polymerized toner is substantially spherical, and thus the polymerized toner has excellent flowability and contributes to high-quality image formation. A coloring agent, such as carbon black, and wax are added to the polymerized toner. An external additive, such as silica, is also added to the polymerized toner to improve flowability. The average particle size of the toner is approximately 6-10 μm.

An agitator 44 is provided in the toner chamber 39. Toner in the toner chamber 39 is agitated by the agitator 44, and is discharged from an opening 45, which communicates front and rear portions under a partition plate 43, toward the supply roller 40.

The supply roller 40 is disposed at the rear side of the opening 45 and rotatably supported by the developing cartridge 31. The supply roller 40 is made by covering a metallic roller shaft with a roller made of a conductive foaming material. The supply roller 40 is rotated by input of power from a motor (not shown).

Figure 3:
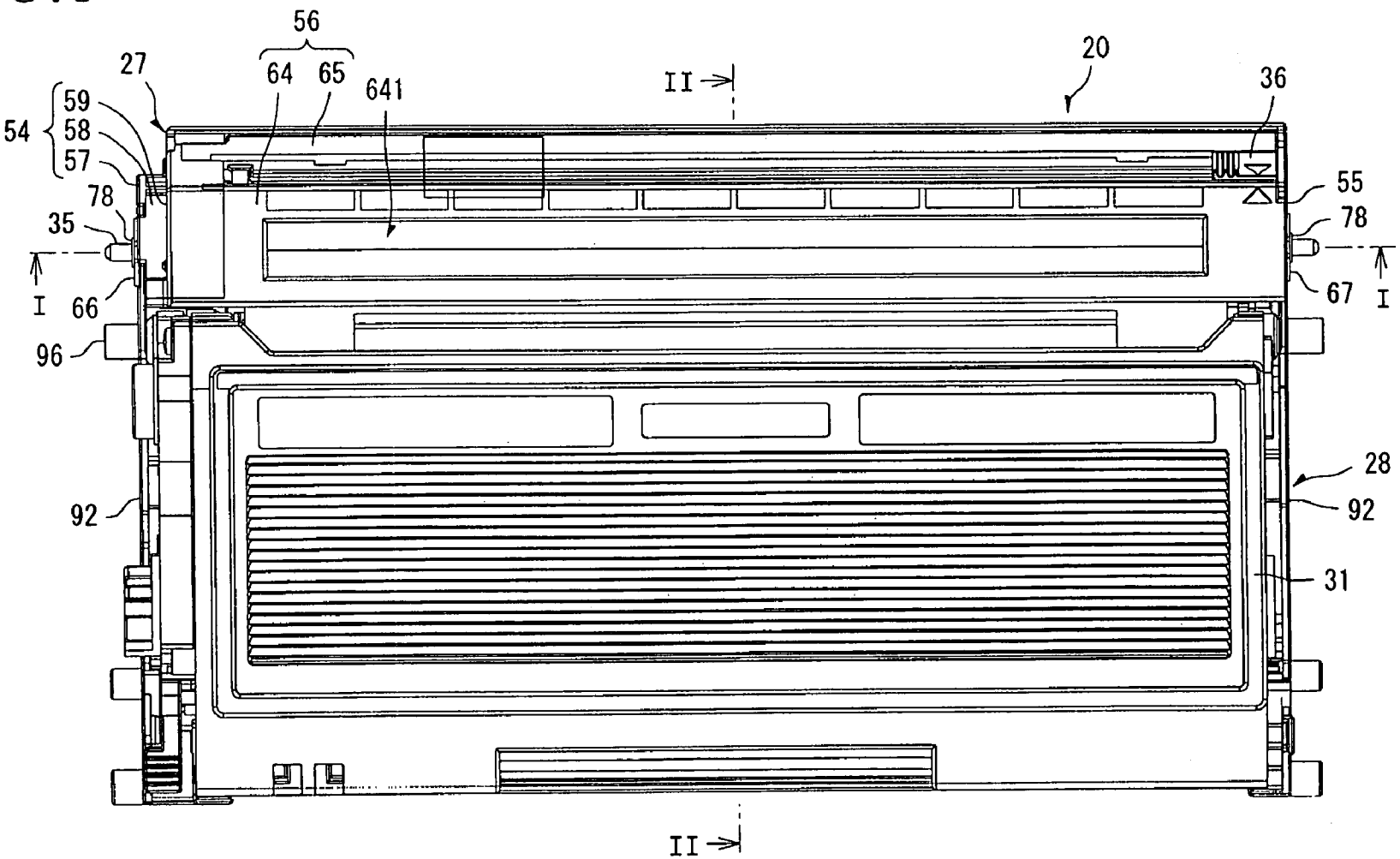
FIG. 3 is a plan view of a process cartridge shown in FIG. 1.
Figure 4:
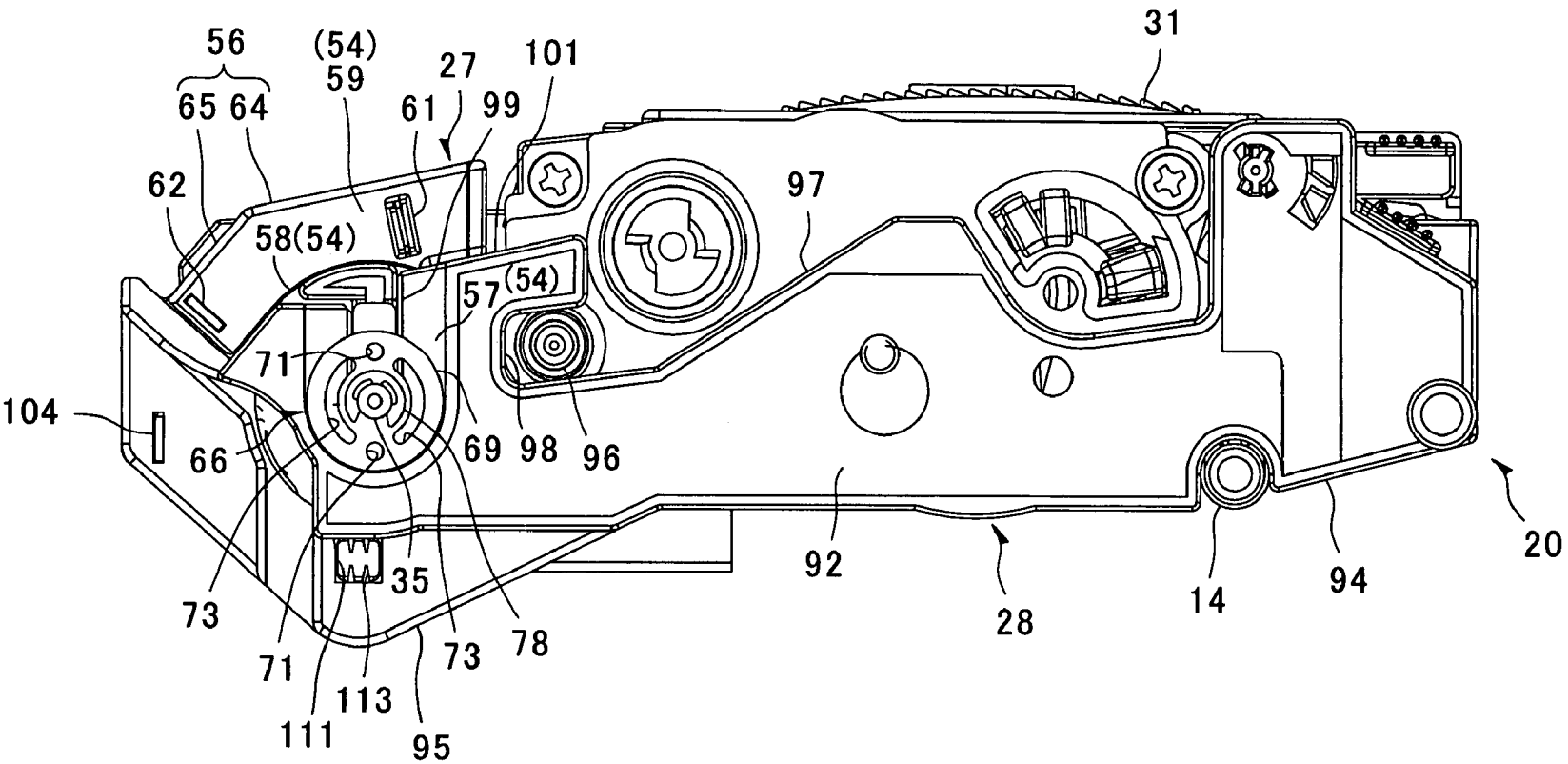
FIG. 4 is a side view of the process cartridge shown in FIG. 1.

The developing roller 41 is rotatably supported by the developing cartridge 31 in order to face the supply roller 40 behind the supply roller 40, in such a manner as to press into contact with the supply roller 40. The developing roller 41 contacts the photosensitive drum 29 when the developing cartridge 31 is mounted in the lower frame 28. The developing roller 41 is made by covering a metallic roller shaft 96 with a roller made of conductive rubber material. Each end of the roller shaft 96 protrudes outward from each side of the developing cartridge 31 in a direction orthogonal to the front-rear direction (FIGS. 3 and 4). The roller of the developing roller 41 is made by covering a roller body made of a conductive urethane or silicone rubber, which includes carbon particles, with a coat layer made of urethane or silicone rubber, which includes fluorine. During developing, a developing bias is applied to the developing roller 41. The developing roller 41 is rotated in the same direction as the supply roller 40 by input of power from a motor (not shown).

The layer-thickness regulating blade 42 includes a blade body 46 made of a metal plate spring member and a pressing portion 47 having a generally semicircular shape in cross section, provided at a free end of the blade body 46, and made of insulative silicone rubber. The layer-thickness regulating blade 42 is supported by the developing cartridge 31 in an upper portion of the developing roller 41, and is pressed against the developing roller 41 by elastic force of the blade body 46.

Toner discharged from the opening 45 is supplied to the developing roller 41 through the rotation of the supply roller 40, while being positively and frictionally charged between the supply roller 40 and the developing roller 41. Toner supplied onto the developing roller 41 goes in between the pressing portion 47 of the layer-thickness regulating blade 42 and the developing roller 41. Along with the rotation of the developing roller 41, the toner is uniformly regulated to a specified thickness as a thin layer and carried on the developing roller 41.

The transfer roller 32 is rotatably supported by the lower frame 28. With the upper frame 27 and the lower frame 28 assembled, the transfer roller 32 is disposed in order to face and contact the photosensitive drum 29 vertically and form a nip between the transfer roller 32 and the photosensitive drum 29. The transfer roller 32 is made by covering a metallic roller shaft 108 with a roller made of a conductive rubber material. During image transfer, a transfer bias is applied to the transfer roller 32. The transfer roller 32 is rotated in an opposite direction to the photosensitive drum 29 by input of power from a motor (not shown).

The cleaning brush 33 is attached to the lower frame 28 and is disposed, with the upper frame 27 and the lower frame 28 assembled, in order to contact the photosensitive drum 29 from the rear.

Along with the rotation of the photosensitive drum 29, the surface of the photosensitive drum 29 is uniformly, positively charged by the scorotron charger 30. Then, a laser beam from the scanner unit 19 is scanned at high speed on the surface of the photosensitive drum 29, thereby forming an electrostatic latent image corresponding to an image to be formed on the sheet 3 thereon.

With the rotation of the developing roller 41, toner carried on the developing roller 41 and positively charged makes contact with the photosensitive drum 29, and is supplied to the electrostatic latent image formed on the surface of the photosensitive drum 29. The toner is supplied to an exposure portion of the uniformly, positively charged surface of the photosensitive drum 29, where the potential has become low due to exposure to the laser beam. As a result, the latent image on the photosensitive drum 29 becomes visible and a reversal takes place. Thus, toner image is formed on the photosensitive drum 29.

The toner image carried on the photosensitive drum 29 is transferred onto the sheet 3 by a transfer bias applied to the transfer roller 32 while the sheet 3, conveyed by the resist rollers 14, passes through a transfer position between the photosensitive drum 29 and the transfer roller 32 as shown in FIG. 1. The sheet 3 to which the toner image has been transferred is conveyed to the fixing part 21.

Toner remaining on the photosensitive drum 29 after toner transfer is collected by the developing roller 41. In addition, paper dust of the sheet 3 adhered on the photosensitive drum 29 after the toner transfer is collected by the cleaning brush 33.

A process cartridge capable of accurately determining a relative position between an image holding member and a charging device, and an image forming apparatus including such a process cartridge and capable of forming a high quality image are provided. An upper frame that supports a scorotron charger is provided with bearing members that receive a drum shaft of a photosensitive drum. A lower frame that supports a transfer roller is provided with bearing member receiving portions that receive the bearing members. The upper frame and the lower frame are assembled and fixed via the bearing members when the bearing member receiving portions receive the bearing members. As a result, a relative position between the upper frame and the lower frame can be accurately determined.

The fixing part 21 is provided to the rear of the process cartridge 20, and includes a heat roller 49 and a pressure roller 50 in a fixing frame 48.

The heat roller 49 is made of a metal tube, and includes a halogen lamp for heating the metal tube. The heat roller 49 is rotated by an input of power from a motor (not shown).

The pressure roller 50 is disposed in a face-to-face relationship with the heat roller 49 so as to press against the heat roller 49 from underneath. The pressure roller 50 is made by covering a metallic roller shaft with a roller made of a rubber material. The pressure roller 50 follows the heat roller 49.

At the fixing part 21, toner transferred onto the sheet 3 at the transfer position is fixed by heat while the sheet 3 passes between the heat roller 49 and the pressure roller 50. The sheet 3, where toner is fixed by heat, is conveyed to a sheet ejection path 51 that extends toward the top surface of the main casing 2. The sheet 3 conveyed to a sheet ejection path 51 is ejected by ejection rollers 52, disposed above the sheet ejection path 51, and is stacked on the sheet discharge tray 53.

Figure 5:
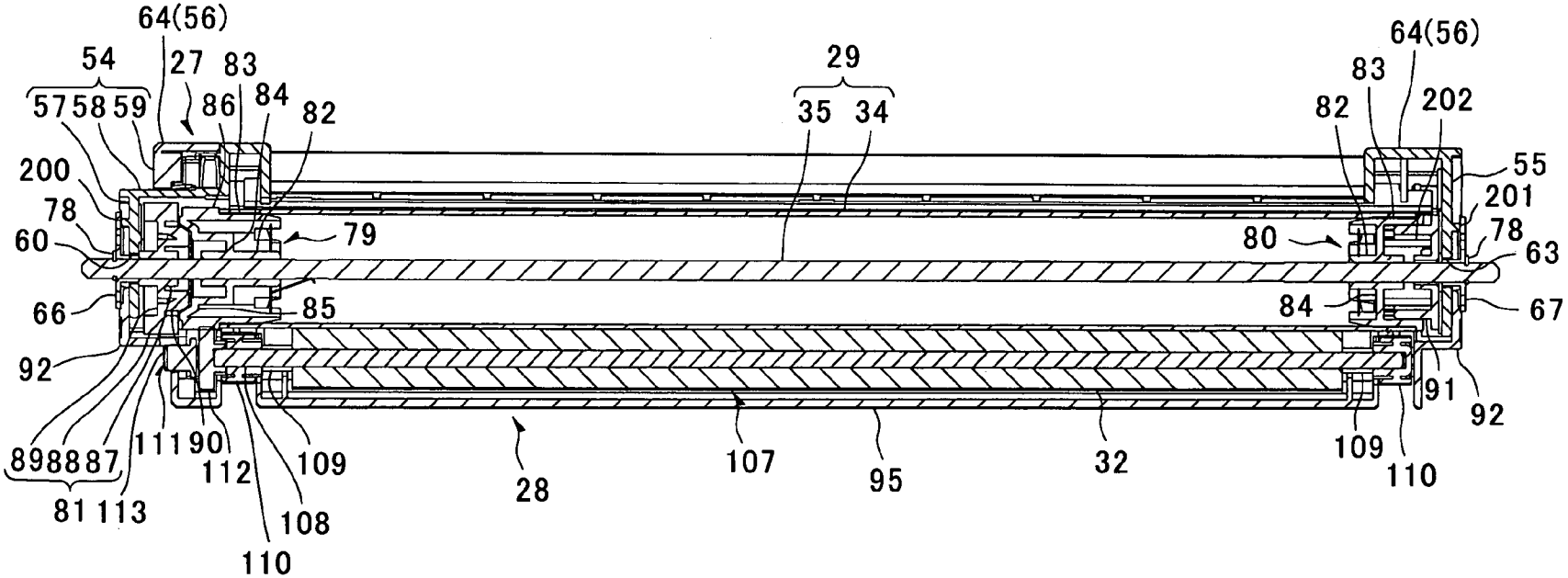
FIG. 5 is a sectional view taken along the line I-I of FIG. 3.

FIG. 3 is a plan view of a process cartridge 20; FIG. 4 is a side view of the process cartridge 20; FIG. 5 is a sectional view taken along the line I-I of FIG. 3; and FIG. 6 is a sectional view taken along the line II-II of FIG. 3.

The upper frame 27 includes a left sidewall 54, a right sidewall 55, and a top wall 56, which are integrally formed, as shown in FIG. 3, and is open at its front and bottom as shown in FIG. 6.

As shown in FIG. 5, the left sidewall 54 includes a left lower side plate portion 57, an overhang plate portion 58, and a left upper side plate portion 59. The left lower side plate portion 57 faces the drum body 34 at one side with respect to a width direction of the drum body 34, which is orthogonal to the front-rear direction (hereinafter the one side with respect to the width direction is referred to as the left side and the other side opposed to the one side is referred to as the right side). The overhang plate portion 58 extends from an upper end of the left lower side plate portion 57 toward the right and covers a drum gear 81 from above. The left upper side plate portion 59 extends upward from the right end of the overhang plate portion 58 (FIG. 10).

The left lower side plate portion 57 is formed with a left-side support hole 60 through which the drum shaft 35 passes and in which a bearing member 66, which functions as a first bearing member and a second bearing member described later, is engaged. In addition, the left lower side plate portion 57 is formed with a spacer portion 200 that protrudes outward to the left around the left-side support hole 60. The spacer portion 200 supports a flange portion 69 of the bearing member 66 with a slight distance away from the left-side lower portion 57.

A wire electrode 61 and a grid electrode 62 are embedded in the left upper side plate portion 59 as shown in FIG. 4. The wire electrode 61 is used for feeding the discharge wire 37 of the scorotron charger 30. The grid electrode 62 is used for feeding the grid 38 of the scorotron charger 30. The upper end of the left upper side plate portion 59 is constructed of a horizontal portion that extends substantially horizontally with respect to the front-rear direction and an inclined portion that is inclined downward from the rear end of the horizontal portion.

As shown in FIG. 5, the right sidewall 55 is formed in substantially a flat plate shape and faces the drum body 34 from the right side. In association with the upper end of the left upper side plate portion 59, the upper end of the right sidewall 55 is constructed of a horizontal portion that extends substantially horizontally with respect to the front-rear direction and faces the horizontal portion of the upper end of the left upper side plate portion 59, and an inclined portion that is inclined downward from the rear end of the horizontal portion and faces the inclined portion of the upper end of the left upper side plate portion 59. The right sidewall 55 is formed with a right-side support hole 63 through which the drum shaft 35 passes. A bearing member 67, which functions as a first bearing member and a second bearing member, which will be described later, is engaged in the right-side support hole 63. The right-side support hole 63 is provided at a position facing the left-side support hole 60 of the left lower side plate portion 57. In addition, the right sidewall 55 is formed with a spacer portion 201 that protrudes outward to the right around the right-side support hole 63. The spacer portion 201 supports a flange portion 69 of the bearing member 67 with a slight distance away from the right sidewall 55 in the left-right direction.

As shown in FIG. 3, the top wall 56 includes a top horizontal portion 64 and a top inclined portion 65.

The top horizontal portion 64 extends between the horizontal portion at the upper end of the left upper side plate portion 59 and the horizontal portion at the upper end of the right sidewall 55. The top horizontal portion 64 is disposed above the photosensitive drum 29. In addition, the top horizontal portion 64 is formed with a laser emission window 641 through which a laser beam scanned at high speed from the scanner unit 19 enters. The laser emission window 641 is open in a rectangular shape in a plan view.

The top inclined portion 65 extends between an inclined portion at the upper end of the left upper side plate portion 59 and an inclined portion at the upper end of the right sidewall 55. The top inclined portion 65 is disposed at a specified distance from the top horizontal portion 64 with respect to the front-rear direction and at an upper rear portion of the photosensitive drum 29.

The scorotron charger 30 is disposed between the top horizontal portion 64 and the top inclined portion 65. In other words, the discharge wire 37 is disposed between the top horizontal portion 64 and the top inclined portion 65, and is extended between the left lower side plate portion 57 and the right sidewall 55. The grid 38 is disposed between the top horizontal portion 64 and the top inclined portion 65 and is extended between the left lower side plate portion 57 and the right sidewall 55. The cleaning member 36 is disposed between the top horizontal portion 64 and the top inclined portion 65, and is provided so as to move in the left-right direction with the discharge wire 37 sandwiched therein. (See FIG. 6)

The drum shaft 35 of the photosensitive drum 29 is supported between the left lower side plate portion 57 and the right sidewall 55 via the bearing members 66, 67 disposed at the left and right sides.

Figure 7:
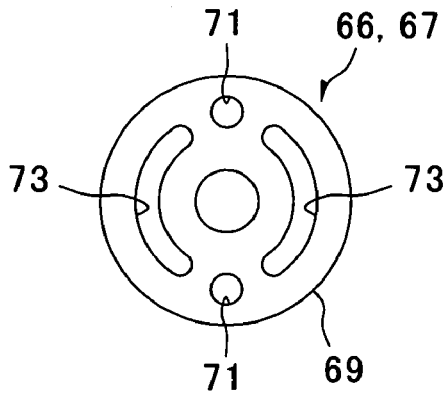
FIG. 7 is a front elevation of a bearing member shown in FIG. 4.
Figure 8:
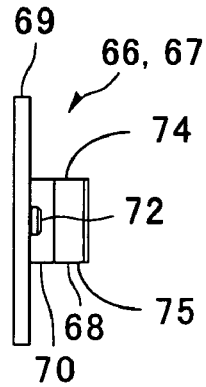
FIG. 8 is a side view of the bearing member shown in FIG. 4
Figure 9:
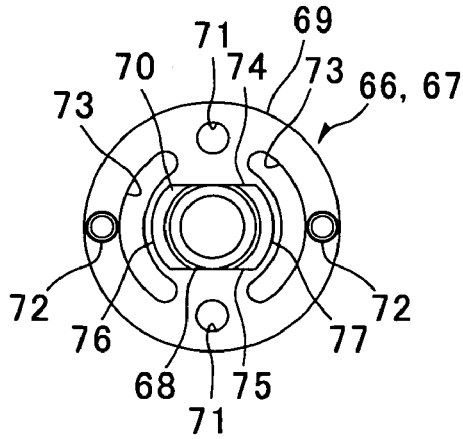
FIG. 9 is a rear elevation of the bearing member shown in FIG. 4.

Each of the bearing members 66, 67 is made of a resin material such as POM (polyacetal resin), ABS (acrylonitrile butadiene styrene resin), and PS (polystyrene resin). As shown in FIGS. 7, 8 and 9, each of the bearing members 66, 67 integrally includes a shaft insertion portion 68, the flange portion 69, and a fixing portion 70.

The shaft insertion portion 68 has an inside diameter substantially the same size as the outside diameter of the drum shaft 35, and is formed into a cylindrical shape so as to cover an outer peripheral surface of the drum shaft 35.

The flange portion 69 is formed in a circular plate jetting out from an end of the shaft insertion portion 68 with respect to its axial direction, in a direction orthogonal to the axial direction. The flange portion 69 is formed with two jig holes 71, which are provided symmetrically with respect to the shaft insertion portion 68. The flange portion 69 is also formed with two engaging protrusions 72, which are located on a side where the shaft insertion portion 68 extends, symmetrically with respect to the shaft insertion portion 68. The engaging protrusions 72 are circular cylindrical shaped engaging stoppers. A direction where the two engaging protrusions 72 are opposed is orthogonal to a direction where the jig holes 71 are opposed. Further, the flange portion 69 is formed with arc-shaped long holes 73 located between the shaft insertion portion 68 and each of the engaging protrusions 72. The long holes 73 are centered on a central axial line of the shaft insertion portion 68. The long holes 73 allow the flange portion 69 to warp, so that the engaging protrusions 72 are moved along the axial direction of the shaft insertion portion 68.

The fixing portion 70 is formed on the same side of the flange portion 69 as the shaft insertion portion 68 extends therefrom so as to protrude around the shaft insertion portion 68 lower than the shaft insertion portion 68. As shown in FIG. 9, the fixing portion 70 is formed so as to jut from the shaft insertion portion 68 toward the engaging protrusions 72. The fixing portion 70 includes a pair of flat side surfaces 74, 75 and a pair of curved side surfaces 76, 77. The flat side surfaces 74, 75 are located in a face-to-face relationship with each other at the same distance away as the outside diameter of the shaft insertion portion 68 in a direction where the jig holes 71 are opposed to each other. The curved side surfaces 76, 77 are located in a face-to-face relationship with each other at a distance away greater than the outside diameter of the shaft insertion portion 68 in a direction where the engaging protrusions 72 are opposed to each other (that is, in the direction orthogonal to the direction of the jig holes 71).

As shown in FIG 5, the left bearing member 66 is attached to the left lower side plate portion 57 by inserting the shaft insertion portion 68 into the left-side support hole 60 from the left side of the left lower side plate portion 57. In this state, the flange portion 69 of the left bearing member 66 is brought into contact with the spacer portion 200, and is spaced a slight distance away from the left lower side plate portion 57. The right bearing member 67 is attached to the right sidewall 55 by inserting the shaft insertion portion 68 into the right-side support hole 63 from the right side of the right sidewall 55. In this state, the flange portion 69 of the bearing member 67 is brought into contact with the spacer portion 201, and is spaced a slight distance away from the right sidewall 55.

End portions of the drum shaft 35 are inserted into the shaft insertion portions 68 of the left and right bearings 66, 67 respectively, and locking members 78 are fitted on the drum shaft 35 from outside. Thereby, the drum shaft 35 is supported by the left sidewall 54 and the right sidewall 55 via the bearing members 66, 67.

Both end portions of the drum shaft 35 protrude outward with respect to the left-right direction from the corresponding bearing members 66, 67. A ground (not shown) is connected to the end portion of the drum shaft 35 that protrudes from the left bearing member 66. The ground is provided in the main casing 2 to ground the drum shaft 35 when the process cartridge 20 is mounted in the main casing 2.

Between the bearing members 66, 67, which are fitted on both end portions of the drum shaft 35, flange members 79, 80 are disposed to receive the drum shaft 35 at both end portions of the drum shaft 35, and the drum gear 81 is disposed on the left end portion of the drum shaft 35. The drum shaft 35 supports the flange members 79, 80 and the drum gear 81 so as to rotate the flange members 79, 80 and the drum gear 81 relative to the drum shaft 35. The drum shaft 35 supports the drum body 34 via the flange members 79, 80 so as to rotate the drum body 34 relative to the drum shaft 35.

The flange members 79, 80 are made of an insulation resin material, and are attached to the both end portions of the drum body 34 in a manner so as to rotate integrally with the drum body 34. Each of the flange members 79, 80 integrally includes a flange bearing portion 82 where the drum shaft 35 is inserted, an insertion portion 83 that is inserted into the drum body 34, and a flange connection portion 84 that connects the flange bearing portion 82 and the insertion portion 83.

The flange bearing portion 82 has an inside diameter substantially the same size as an outside diameter of the drum shaft 35, and is formed into a cylindrical shape so as to cover an outer peripheral surface of the drum shaft 35. The insertion portion 83 has an outside diameter substantially the same size as an inside diameter of the drum body 34, and is formed into a cylindrical shape so as to be inserted in contact with the inner peripheral surface of the drum body 34. The flange connection portion 84 is formed in an annular plate shape so as to extend between the flange bearing portion 82 and the insertion portion 83 in a radial direction of the drum body 34.

The left flange member 79 is integrally formed with a flange-side connection portion 85 and an output gear 86. The flange-side connection portion 85 is used for connection with the drum gear 81 and the output gear 86 is used for engagement with a transfer gear 112. The flange-side connection portion 85 is constructed so as to protrude leftward at its outer edge with respect to the radial direction of the flange connection portion 84. The output gear 86 is of substantially cylindrical shape that extends leftward continuously from the insertion portion 83. The output gear 86 includes a plurality of external teeth that protrude outward with respect to the radial direction to mesh with the transfer gear 112.

The drum gear 81 is provided on the left side of the left flange member 79, and integrally includes a gear bearing portion 87 where the drum shaft 35 is inserted, an input gear 88 that engages a driving transmission gear (not shown), and a gear connection portion 89 that connects the gear bearing portion 87 and the input gear 88.

The gear bearing portion 87 has an inside diameter substantially the same size as the outside diameter of the drum shaft 35, and is formed into a cylindrical shape so as to cover an outer peripheral surface of the drum shaft 35. The input gear 88 is of substantially a cylindrical shape. The input gear 88 includes a plurality of external teeth that protrude outward with respect to the radial direction to mesh with the driving transmission gear (not shown). The gear connection portion 89 is formed in an annular plate shape so as to extend between the gear bearing portion 87 and the input gear 88 in the radial direction of the gear connection portion 89.

In addition, the gear connection portion 89 is integrally formed with a gear-side connection portion 90 intended for connection to the flange-side connection portion 85 of the left flange member 79. The gear-side connection portion 90 is constructed so as to protrude rightward from a middle of the gear connection portion 89 with respect to its radial direction.

The drum gear 81 is bonded to the left flange member 79 by confronting the gear bearing portion 87 and the flange bearing portion 82 of the left flange member 79 and adhesively fixing the gear-side connection portion 90 and the flange-side connection portion 85 of the left flange member 79. The drum gear 81 is rotated integrally with the left flange member 79. As an alternative, the drum gear 81 may be integrally formed with the left flange member 79.

The left flange member 79 and the drum gear 81 are attached to the left end portion of the drum body 34 in a manner so as to rotate integrally with the drum body 34 by inserting the drum shaft 35 into the flange bearing portion 82 and the gear bearing portion 87 and press-fitting the insertion portion 83 from a left-side opening of the drum body 34.

The right flange member 80 is attached to the right end portion of the drum body 34 in a manner so as to rotate integrally with the drum body 34 by inserting the drum shaft 35 into the flange bearing portion 82 and press-fitting the insertion portion 83 from a right-side opening of the drum body 34.

Accordingly, each of the flange members 79, 80 is attached to the corresponding one of both end portions of the drum body 34 to rotate integrally with the drum body 34, and is supported by the drum shaft 35 so that they are rotated relative to the drum shaft 35. Thus, the photosensitive drum 29 is rotatably supported by the drum shaft 35 via the flange members 79, 80.

The right sidewall 55 facing the right flange member 80 is provided with a spring receiving member 91 through which the drum shaft 35 passes and a spring 202 that is received by the spring receiving member 91 between the right sidewall 55 and the right flange member 80.

The spring receiving member 91 is formed in a shape of an inverse C letter in cross section, and opens leftward. The spring receiving member 91 is supported at the inside of the right sidewall 55. The spring 202 is provided around the drum shaft 35, and urges the flange member 80 toward the left when held by the spring receiving member 91. In this manner, the drum gear 81 bonded to the left flange member 79 is brought into contact with the left lower side plate portion 57 of the left sidewall 54, so that the photosensitive drum 29 is positioned with respective to its axial direction.

When a driving force is transmitted from a motor (not shown) provided in the main casing 2 to a drive transmission gear (not shown), the input gear 88 in mesh with the drive transmission gear is rotated and thus the photosensitive drum 29 is rotated.

The lower frame 28 integrally includes a pair of sidewalls 92 (FIG. 5), a rear connection portion 93, a lower front connection portion 94, and a lower rear connection portion 95 (FIG. 6) that all connect bottom edge portions of the sidewalls 92. The lower frame 28 is shaped so as to open upward.

As shown in FIG. 5, the pair of sidewalls 92 are disposed opposite to each other to sandwich the developing cartridge 31 (FIG. 4) therebetween. As shown in FIGS. 4 and 10, each sidewall 92 includes a roller shaft guiding portion 97, a roller shaft receiving portion 98, a bearing member guiding portion 99, and a bearing member receiving portion 100. The roller shaft guiding portion 97 is used for guiding a roller shaft 96 of the developing roller 41 when the developing cartridge 31 is attached to or removed from the lower frame 28. The roller shaft receiving portion 98 is provided at a rear end of the roller shaft guiding portion 97 to receive an end portion of the roller shaft 96 guided by the roller shaft guiding portion 97. At a rear of the roller shaft receiving portion 98, the bearing member guiding portion 99 forms a path for guiding the fixing portion 70 of the bearing member 66, 67 when the upper frame 27 is attached to or removed from the lower frame 28. The bearing member receiving portion 100 is provided at a bottom portion of the bearing member guiding portion 99 to receive the fixing portion 70 guided by the bearing member guiding portion 99.

The roller shaft guiding portion 97 is formed as an upper edge of the each sidewall 92 at substantially a center with respect to the front-rear direction. The roller shaft guiding portion 97 extends obliquely downward from the front to the rear, and then extends substantially horizontally.

In each sidewall 92, the roller shaft receiving portion 98 is continuous with the rear side of the shaft guiding portion 97 and is formed in a substantially rectangular shape so as to be recessed from a front end portion of a protrusion portion 101 that protrudes frontward at an upper portion of the roller shaft receiving portion 98.

A space further forward than the roller shaft receiving portion 98 is used for attaching the developing cartridge 31. Each end portion of the roller shaft 96, which protrudes from both sides of the developing cartridge 31, is guided by the roller shaft guiding portion 97, is moved toward the roller shaft receiving portion 98, and is received by the roller shaft receiving portion 98. Thus, the end portion of the developing cartridge 31 is supported by the pair of the sidewalls 92. In this manner, the developing cartridge 31 is mounted in this space.

When the developing cartridge 31 is mounted in the lower frame 28, both end portions of the roller shaft 96 are exposed outward from the sidewalls 92 via the roller shaft receiving portions 98 (FIG 3). When the process cartridge 20 is mounted in the main casing 2, an electrode for applying a developing bias is connected to the left end portion of the roller shaft 96.

The bearing member guiding portion 99 is a substantially U-shaped groove that vertically extends from the top end of the protrusion portion 101 of each sidewall 92 toward a lower place and opens at its top. The bearing member guiding portion 99 is formed so that its width is substantially the same distance as an interval between the flat side surfaces 74, 75 of the fixing portion 70 of each bearing member 66, 67. With this formation, when the flat side surfaces 74, 75 are along a guide direction (vertical direction) of the bearing member guiding portion 99, the fixing portion 70 is allowed to enter the bearing member guiding portion 99. Alternatively, when the flat side surfaces 74, 75 intersect with the guide direction of the bearing member guiding portion 99, the fixing portion 70 cannot enter the bearing member guiding portion 99.

The bearing member receiving portion 100 is formed so as to spread in a circle in sectional view from the bearing member guiding portion 99 at the bottom end portion of the bearing member guiding portion 99. The bearing member receiving portion 100 is formed so that its diameter defining an interior surface of the bearing member receiving portion 100 is substantially the same distance as an interval between the curved side surfaces 76, 77 of the fixing portion 70 of each bearing member 66, 67. In addition, the curvature of the interior surface is substantially the same as the curvature of each curved side surface 76, 77. With this formation, the fixing portion 70 of each bearing member 66, 67 guided by the bearing member guiding portion 99 is rotatably received in the bearing member receiving portion 100.

On an outer surface of each sidewall 92, two engaging recessed portions 102 are formed symmetrically with respect to the bearing member receiving portion 100 so as to face each other at the same distance away as an interval between the two engaging protrusions 72 of each bearing member 66, 67 in the front-rear direction. The recessed portions 102 are engaged stoppers that are recessed from the outer surface in substantially a rectangular shape in a plan view. On the outer surface of each sidewall 92, a receiving recessed portion 103 is also formed under the bearing member receiving portion 100. The receiving recessed portion 103 is recessed in substantially a rectangular shape in plan view from the outer surface where the engaging protrusions 72 are received when the bearing member receiving portion 100 receives the fixing portion 70.

The left sidewall 92 is formed with an opening 111 for exposing a transfer electrode 113 under the bearing member receiving portion 100. Further, the left sidewall 92 is provided with a cleaning electrode 104 for applying a cleaning bias to the cleaning brush 33 at the rear of the bearing member receiving portion 100.

As show in FIG. 6, the rear connection portion 93 connects the pair of sidewalls 92 at their rear end portions. The rear connection portion 93 is provided with a wall portion 105 that faces the photosensitive drum 29 at the rear thereof. The cleaning brush 33 is attached to the wall portion 105.

The lower front connection portion 94 connects the pair of sidewalls 92 at their lower front end portions. The lower front connection portion 94 includes a resist roller accommodating portion 106 for accommodating the upper resist roller 14.

The lower rear connection portion 95 connects the pair of sidewalls 92 at their lower rear end portions under the bearing member receiving portion 100, as shown in FIG. 4. The lower rear connection portion 95 includes a transfer roller accommodating portion 107 for accommodating the transfer roller 32, as shown in FIG. 6. In addition, the lower rear connection portion 95 is provided with roller bearings 109 at opposite end portions of the transfer roller accommodating portion 107 with respect to its width, as shown in FIG. 5. The roller bearings 109 receive the opposite end portions of the roller shaft 108 in the transfer roller 32. The roller shaft 108 is received by the roller bearings 109 at both end portions, so that the transfer roller 32 is rotatably supported by the lower rear connection portion 95.

The roller shaft 108 of the transfer roller 32 protrudes outward from the roller bearings 109 at both end portions. Cover members 110 are attached to both end portions of the roller shaft 108, which protrude outward. The cover members 110 are made of an insulation resin material. The cover members 110 prevent the roller shaft 108 from being exposed at both end portions of the drum body 34, so that discharging from the roller shaft 108 to the drum body 34 can be prevented when the transfer bias is applied.

The left end portion of the roller shaft 108 is covered with a transfer electrode 113 for applying a transfer bias. The transfer electrode 113 is exposed outward to the left via the opening 111 on the left sidewall 92.

The transfer gear 112 is mounted on the roller shaft 108 between the cover member 110 and the transfer electrode 113 in a manner so as to rotate integrally with the roller shaft 108. The transfer gear 112 includes a plurality of external teeth that protrude outward with respect to the radial direction to mesh with the output gear 86 of the left flange member 79. With this structure, when the photosensitive drum 29 is rotated by a driving force from a motor (not shown) provided in the main casing 2, the output gear 86 of the left flange member 79 attached to the photosensitive drum 29 is rotated. Concurrently, the transfer gear 112 in mesh with the output gear 86 is rotated, and the transfer roller 32 is rotated.

Figure 11A:
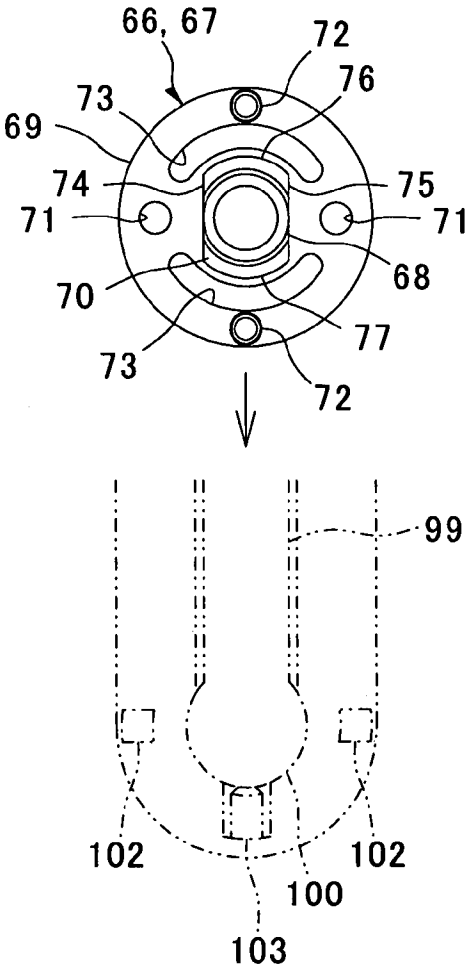
FIGS. 11A, 11B, and 11C illustrate movements of the bearing member shown in FIG. 4 when the upper frame and the lower frame are fixed.
Figure 11B:
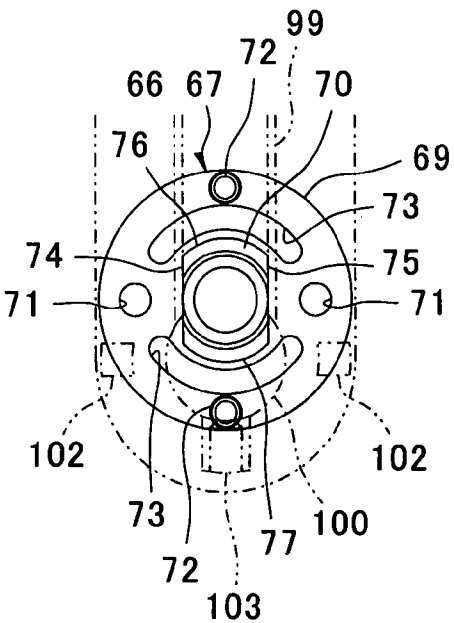

In the process cartridge 20, the upper frame 27 is assembled to the lower frame 28 from above, as shown in FIG. 10. At this time, as shown in FIG. 11A, each bearing member 66, 67 is disposed so that each flat side surface 74, 75 of the fixing portion 70 can follow the guide direction of the bearing member guiding portion 99 of the lower frame 28. Then, as shown in FIG. 11B, the fixing portion 70 is inserted into the bearing member guiding portion 99 from above, so that the fixing portion 70 is guided by the bearing member guiding portion 99 and is moved toward the bearing member receiving portion 100. When the fixing portion 70 is received by the bearing member receiving portion 100, the sidewalls 92 of the lower frame 28 become caught in the gap between the flange portion 69 of the left bearing member 66 and the left sidewall 54 and in the gap between the flange portion 69 of the bearing member 67 and the right sidewall 55, respectively (FIG. 5). The inner surface (on which the shaft insertion portion 68 extends) of the flange portion 69 of each of the bearing members 66, 67 makes intimate contact with the outer surface of each of the sidewalls 92.

Figure 11C:
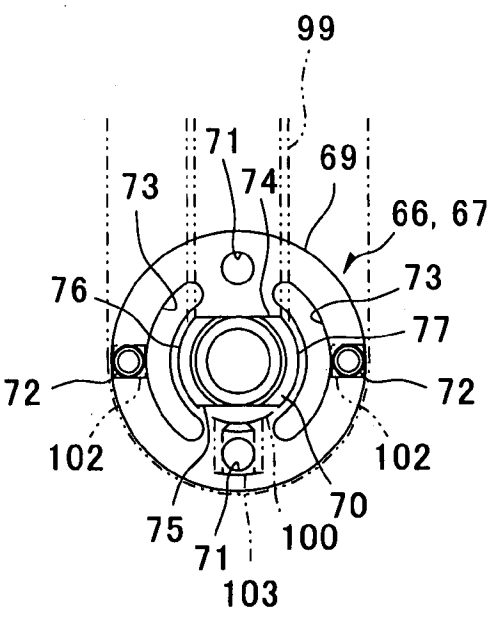

Immediately after the fixing portion 70 is received by the bearing member receiving portion 100, the lower engaging protrusion 72 is received by the receiving recessed portion 103 formed on the sidewall 92. Thereafter, a jig (not shown) is inserted into the jig holes 71 of the flange portion 69. Using the jig, the flange portion 69 is warped so as to separate the engaging protrusion 72 away from the sidewall 92, and each of the bearing members 66, 67 is rotated approximately 90 degrees around the drum shaft 35. As shown in FIG. 11C, the engaging protrusions 72 formed on the inner surface of the flange portion 69 face the corresponding engaging recessed portions 102 formed on the outer surface of the sidewall 92. When the jig is removed from the jig holes 71, the flange portion 69 returns to the original position in intimate contact with the sidewall 92, and the engaging protrusions 72 are fitted into the engaging recessed portions 102. Thus, each bearing member 66, 67 is engaged with the lower frame 28 under a condition that its rotation is controlled. When each bearing member 66, 67 is rotated approximately 90 degrees around the drum shaft 35, the fixing portion 70, which has been arranged so that the flat side surfaces 74, 75 follow the guide direction of the bearing member guiding portion 99 in the bearing member receiving portion 100, is also rotated approximately 90 degrees. The flat side surfaces 74, 75 are thus disposed orthogonal to the guide direction and the curved side surfaces 76, 77 are located to follow the guide direction. As a result, the fixing portion 70 is prevented from moving in the bearing member guiding portion 99 and is fixed in the bearing member receiving portion 100. With this structure, each bearing member 66, 67 is supported by the lower frame 28. As a result, the upper frame 27 and the lower frame 28 are fixed in an assembled state.

By assembling the upper frame 27 and the lower frame 28 in this manner, each bearing member 66, 67 is received and supported by the bearing member receiving portion 100 formed in the lower frame 28, so that the upper frame 27 and the lower frame 28 are connected and a relative position between the upper frame 27 and the lower frame 28 is determined via each bearing member 66, 67. In other words, the relative position between the upper frame 27 and the lower frame 28 is determined with reference to the drum shaft 35 of the photosensitive drum 29 supported by each bearing member 66, 67. The photosensitive drum 29, the scorotron charger 30, and the cleaning brush 33 are supported by the upper frame 28, and a relative position among the photosensitive drum 29, the scorotron charger 30, and the cleaning brush 33 is determined with reference to each bearing member 66, 67 that receives the drum shaft 35 of the photosensitive drum 29, independently of assembling to the lower frame 28. The developing cartridge 31 and the transfer roller 32 are supported by the lower frame 28. When the upper frame 27 is assembled to the lower frame 28, relative positions of the developing cartridge 31 and the transfer roller 32 with respect to the upper frame 27 are determined with reference to each bearing member 66, 67 that receives the drum shaft 35 of the photosensitive drum 29. As further illustrated by FIG. 5, the upper frame 27 and each bearing member 66, 67 sandwich the lower frame 28 when the upper frame 27 is assembled with the lower frame 28.

As a result, a relative position between the photosensitive drum 29 and each of the members, which are disposed around the photosensitive drum 29, i.e. the scorotron charger 30, the developing cartridge 31, the transfer roller 32, and the cleaning brush 33, is determined with reference to the drum shaft 35 supported by each bearing member 66, 67. Each of these members functions as a processing device capable of conducting a specified operation with respect to the photosensitive drum 29.

Thus, if the upper frame 27 and the lower frame 28 have their own manufacturing errors, the relative position between the upper frame 27 and the lower frame 28 is accurately determined via the bearing members 66, 67, with the result that the relative position among the scorotron charger 30, the developing cartridge 31, the transfer roller 32, and the cleaning brush 33 with respect to the photosensitive drum 29 can be also accurately determined.

Thus, the photosensitive drum 29 is accurately charged by the scorotron charger 30, an image on the photosensitive drum 29 is accurately developed by the developing cartridge 31 and is transferred onto a sheet 3 by the transfer roller 32, and further the surface of the photosensitive drum 29 is accurately cleaned by the cleaning brush 33. Accordingly, the laser printer 1 including the process cartridge 20 can produce a high quality image on the sheet 3.

In this process cartridge 20, when the upper frame 27 and the lower frame 28 are assembled, the fixing portion 70 of each bearing member 66, 67 is guided by the bearing member guiding portion 99 provided in the lower frame 28. Thus, the upper frame 27 and the lower frame 28 can be easily assembled in a state where the relative position between the upper frame 27 and the lower frame 28 is accurately determined.

Further, in this process cartridge 20, the upper frame 27 and the lower frame 28 are assembled, the fixing portion 70 of each bearing member 66, 67 is received by the bearing member receiving portion 100, and then the fixing portion 70 of each bearing member 66, 67 is rotated so as to be orthogonal to the guide direction of the bearing member guiding portion 99. This arrangement can prevent the fixing portion 70 from disjoining from the bearing member receiving portion 100 via the bearing member guiding portion 99. As a result, the upper frame 27 and the lower frame 28 can be prevented from disjoining from each other with ease and reliability. Thus, the upper frame 27 and the lower frame 28 can be easily fixed.

After that, if the fixing portion 70 of each bearing member 66, 67 is rotated further approximately 90 degrees so as to follow the guide direction of the bearing member guiding portion 99, the fixing portion 70 can be disjoined from the bearing member receiving portion 100 via the bearing member guiding portion 99, and the upper frame 27 and the lower frame 28 can be also disjoined from each other with ease. That is, in this process cartridge 20, by rotating each bearing member 66, 67 around the drum shaft 35 by approximately 90 degrees, the upper frame 27 can be alternately moved between a fixing position where the upper frame 27 is fixed to the lower frame 28 and an unfixing position where the fixing of the upper frame 27 to the lower frame 28 is unfixed. As a result, the upper frame 27 and the lower frame 28 can be easily fixed or unfixed, with the result that operability for assembling and disjoining can be improved.

As the upper frame 27 and the lower frame 28 are fixed or unfixed by rotation of each bearing member 66, 67, the number of parts that constitute the process cartridge 20 can be reduced and the configuration can be simplified, compared with a configuration that a fixing device for fixing the upper frame 27 and the lower frame 28 to each other is additionally provided. As a result, the cost of the process cartridge 20 can be reduced.

Further, while the fixing portion 70 of each bearing member 66, 67 is orthogonal to the guide direction of the bearing member guiding portion 99, the engaging protrusions 72 of each bearing member 66, 67 are fitted into the engaging recessed portions 102, which can prevent each bearing member 66, 67 from rotating unnecessarily relative to the lower frame 28. Thus, the upper frame 27 and the lower frame 28 can be prevented from disjoining from each other unnecessarily.

When the engaging protrusions 72 are engaged with or disengaged from the engaging recessed portions 102, the bearing members 66, 67 are rotated while the flange portions 69 are warped. The engaging protrusions 72 can be easily engaged with or disengaged from the engaging recessed portions 102.

In the above embodiment, the bearing members 66, 67 are provided at the upper frame 27. However, bearing members may be provided at both the upper frame 27 and the lower frame 28 individually.

Figure 12:
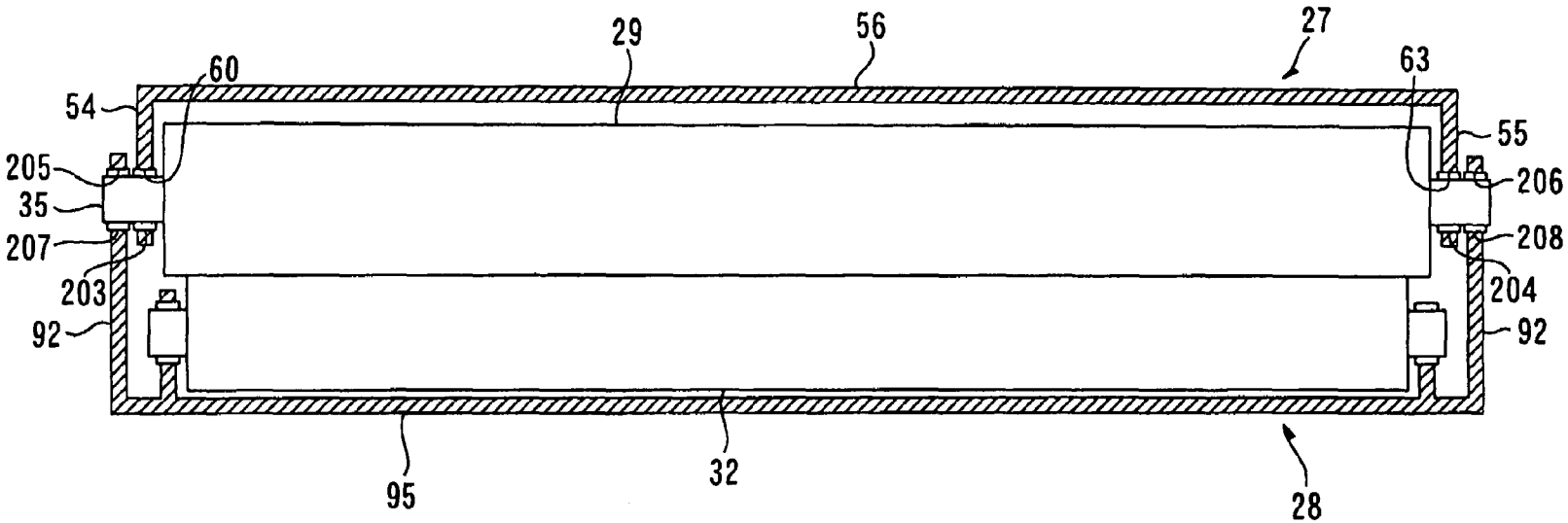
FIG. 12 is a schematic sectional view of an abbreviated structure of a laser printer according to another embodiment of the disclosure in which a first bearing member and a second bearing member are provided individually on each side.

In this case, as schematically shown in FIG. 12, for example, the upper frame 27 may be provided with first bearing members 203, 204 for supporting the drum shaft 35 at the left-side support hole 60 on the left sidewall 54 and the right-side support hole 63 on the right sidewall 55. Instead of forming the bearing member guiding portion 99 and the bearing member receiving portion 100 on the pair of sidewalls 92 of the lower frame 28, the lower frame 28 may be provided with shaft insertion holes 205, 206 through which the drum shaft 35 passes. Second bearing members 207, 208 may be provided at the shaft insertion holes 205, 206.

In this case, for example, the upper frame 27 and the lower frame 28 may be disposed so as to align the left-side support hole 60 and the right-side support hole 63 of the upper frame 27 with the shaft insertion holes 205, 206 in the axial direction. The drum shaft 35 may be inserted into the first bearing members 203, 204 and the second bearing members 207, 208, and may be supported by the upper frame 27 and the lower frame 28 via the first bearing members 203, 204 and the second bearing members 207, 208.

Accordingly, although the upper frame 27 and the lower frame 28 are separately provided, the scorotron charger 30, the developing cartridge 31, the transfer roller 32, and the cleaning brush 33 can be positioned accurately in relation to the photosensitive drum 29.

According to an exemplary aspect of the disclosure, a relative position between an image holding member and a charging device is determined according to a relative position between a bearing portion that receives a shaft of the image holding member and the charging device. As the bearing portion and the charging device are supported by the first frame, the relative position between the image holding member and the charging device can be accurately determined.

According to an exemplary aspect of the disclosure, the relative position between the image holding member and the charging device is irrelevant to a relative position between the first frame and the second frame. Thus, even if an error occurs in the relative position between the first frame and the second frame when assembled, the relative position between the image holding member and the charging device can be maintained regardless of the error. When the second frame supports the transfer device and the bearing portion when the first frame is assembled with the second frame, the relative position between the image holding member and the charging device can be accurately determined.

According to an exemplary aspect of the disclosure the relative position between the image holding member and the at least one of the plurality of processing devices supported by the first frame is determined according to the relative position between the at least one of the plurality of processing devices supported by the first frame and the bearing portion that receives the shaft of the image holding member. The relative position between the image holding member and the at least one of the plurality of processing devices supported by the second frame is determined according to the relative position between the at least one of the plurality of processing devices supported by the second frame and the bearing portion that receives the shaft of the image holding member. That is, the relative position between the image holding member and the processing devices supported by the first frame and the second frame is determined with reference to the shaft of the image holding member that is received by the bearing portion. Thus, even if an error occurs in the relative position between the first frame and the second frame when assembled, the relative position between the image holding member and the processing devices supported by the first frame and the second frame can be accurately determined by the bearing portion that receives the shaft of the image holding member.

According to an exemplary aspect of the disclosure, relative positions of the charging device and the transfer device with respect to the image holding member can be accurately determined. According to an exemplary aspect of the disclosure, the relative position between the image holding member and the transfer device can be accurately determined.

According to an exemplary aspect of the disclosure, the second frame is assembled with respect to the shaft of the image holding member supported by the first frame and is positioned with respect to the first frame. Thus, the relative position between the first frame and the second frame can be accurately determined with reference to the shaft of the image holding member.

According to an exemplary aspect of the disclosure, the relative position between the first frame and the second frame can be accurately determined via the bearing members.

According to an exemplary aspect of the disclosure, when the first frame and the second frame are assembled, the bearing member is guided to a path provided in the second frame. Thus, the first frame and the second frame can be easily assembled in a state where the relative position therebetween is accurately determined.

According to an exemplary aspect of the disclosure, the first frame and the second frame can be fixed to each other via the bearing member. Thus, comparing to a structure where a fixing device capable of fixing the first frame and the second frame to each other is additionally required, the number of parts comprised of the process cartridge can be reduced, thereby providing a simplified structure. As a result, the cost of the process cartridge can be reduced.

According to an exemplary aspect of the disclosure, the first frame and the second frame can be easily fixed to or separated from each other by rotating the bearing member around the shaft of the image holding member by a specified angle, thus improving workability.

According to an exemplary aspect of the disclosure, when first frame and the second frame are assembled, the fixing portion of the bearing member is passed along the path provided in the second frame. Accordingly, the first frame and the second frame can be assembled with the relative position therebetween accurately determined. In addition, when the fixing portion of the bearing member is disposed orthogonal to the path in a condition that the first frame and the second frame are assembled, the fixing portion can be prevented from passing the path, and the first frame and the second frame can be prevented from disjoining from each other. In other words, via the fixing portion of the bearing member, the first frame and the second frame can be assembled in a condition where the relative position therebetween is accurately determined, and the assembled first and second frames can be fixed.

According to an exemplary aspect of the disclosure, after the fixing portion of the bearing member is received by the receiving portion of the second frame, the bearing member is rotated so that the fixing portion is disposed orthogonal to the path. Thus, the fixing portion can be prevented from separating from the receiving portion with reliability. As a result, the first frame and the second frame can be surely fixed to each other.

According to an exemplary aspect of the disclosure, the bearing member can be prevented from rotating unnecessarily by engaging the engaging portion of the bearing member with the second frame. Thus, the first frame and the second frame can be prevented from separating from each other unnecessarily.

According to an exemplary aspect of the disclosure, the bearing member can be prevented from rotating unnecessarily by engaging the engaging portion of the bearing member with the engaged portion of the second frame.

According to an exemplary aspect of the disclosure, when the engaging portion is engaged with or separated from the second frame, the bearing member can be rotated by warping the flange portion. Thus, engagement and separation of the engaging portion with respect to the second frame can be simplified.

While this disclosure has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

What is claimed is:

1. A process cartridge comprising:

an image holding member capable of holding a developing agent image thereon;

a shaft that supports the image holding member;

a bearing portion that receives the shaft, the bearing portion including a shaft insertion portion through which the shaft is inserted, the bearing portion having at least two protrusions;

a charging device that is capable of charging the image holding member;

a first frame that supports the bearing portion and the charging device; and a second frame that is provided separately from the first frame, the second frame receiving the bearing portion and configured with holes corresponding to the protrusions on the bearing portion, wherein the first frame and the bearing portion sandwich the second frame when the first frame is assembled with the second frame, wherein the protrusions on the bearing portion are biased against the second frame and fit in the corresponding holes in the second frame to fix the first frame and the second frame to each other when the first frame is assembled with the second frame, and wherein the protrusions are located symmetrically with respect to the shaft insertion portion.

2. The process cartridge according to claim 1, further comprising:

a transfer device capable of transferring the developing agent image held on the image holding member to a transfer medium, wherein the second frame supports the transfer device.

3. A process cartridge comprising:

an image holding member capable of holding a developing agent image thereon;

a shaft that supports the image holding member;

a bearing portion that receives the shaft, the bearing portion including a shaft insertion portion through which the shaft is inserted, the bearing portion having at least two protrusions;

a plurality of processing devices, each processing device capable of conducting a specified operation with respect to the image holding member;

a first frame that supports the bearing portion and at least one of the plurality of processing devices; and a second frame that supports the bearing portion and at least one of the plurality of processing devices except for the at least one of the plurality of processing devices supported by the first frame, and configured with holes corresponding to the protrusions on the bearing portion, wherein the first frame and the bearing portion sandwich the second frame when the first frame is assembled with the second frame, wherein the protrusions on the bearing portion are biased against the second frame and fit in the corresponding holes in the second frame to fix the first frame and the second frame to each other when the first frame is assembled with the second frame, and wherein the protrusions are located symmetrically with respect to the shaft insertion portion.

4. The process cartridge according to claim 3, wherein the at least one of the plurality of processing devices supported by the first frame includes a charging device capable of charging the image holding member, and the at least one of the plurality of processing devices supported by the second frame includes a transfer device capable of transferring the developing agent image to a transfer medium.

5. The process cartridge according to claim 4, wherein the second frame includes a path that guides the bearing portion when the second frame is assembled with the first frame.

6. A process cartridge comprising:

an image holding member capable of holding a developing agent image thereon;

a shaft that supports the image holding member;

a bearing member that receives the shaft, the bearing member including a shaft insertion portion through which the shaft is inserted, the bearing member having at least two protrusions;

a first frame that supports the shaft; and a second frame positioned with reference to the shaft when the second frame is assembled with the first frame, the second frame configured with holes corresponding to the protrusions on the bearing member, wherein the first frame and the bearing member sandwich the second frame when the first frame is assembled with the second frame, wherein (1) the bearing member receives the shaft, (2) the second frame is positioned with respect to the shaft via the bearing member and (3) the bearing member is rotatable around the shaft independently from the first frame and the second frame when the first frame is assembled with the second frame such that the protrusions on the bearing member are biased against the second frame and fit in the corresponding holes in the second frame, and wherein the protrusions are located symmetrically with respect to the shaft insertion portion.

7. The process cartridge according to claim 6, further comprising a charging device that is supported by the first frame, the charging device capable of charging the image holding member.

8. The process cartridge according to claim 6, further comprising a transfer device that is supported by the second frame, the transfer device capable of transferring the developing agent image held on the image holding member to a transfer medium.

9. The process cartridge according to claim 6 wherein the second frame includes a path that guides the bearing member when the second frame is assembled with the first frame.

10. The process cartridge according to claim 6, wherein the bearing member includes a fixing device that is capable of fixing the first frame to the second frame when the first frame is assembled with the second frame.

11. The process cartridge according to claim 10, wherein the bearing member is movable between a fixing position and an unfixing position by a rotation for a specified angle around the shaft when the first frame is assembled with the second frame, the first frame is fixed to the second frame when the bearing member is in the fixing position, and the first frame is unfixed with respect to the second frame when the bearing member is in the unfixing position.

12. The process cartridge according to claim 11, wherein the bearing member includes a shaft insertion portion through which the shaft is inserted, a flange portion provided around the shaft insertion portion, and an engaging portion provided at a surface of the flange portion, and the surface of the flange portion faces the second frame when the first frame and is assembled with the second frame.

13. The process cartridge according to claim 12, wherein the second frame includes an engaged portion to which the engaging portion is engaged.

14. The process cartridge according to claim 12, wherein the flange portion is formed with a hole, and the flange portion is warped via the hole so that the engaging portion is movable in directions where the engaging portion makes contact with the second frame or is separated away from the second frame.

15. The process cartridge according to claim 10, wherein the bearing member includes a shaft insertion portion through which the shaft is inserted, and a fixing portion provided around the shaft insertion portion, and the fixing portion has a first width smaller than a width of the path and a second width greater than the width of the path.

16. The process cartridge according to claim 15, wherein the second frame includes a receiving portion capable of receiving the fixing portion, the receiving portion is provided at an end of the path, and the receiving portion has a width greater than the width of the path and substantially equal to the second width of the fixing portion.

17. The process cartridge according to claim 16, wherein the fixing portion includes a first flat side surface, a second flat side surface, a first curved side surfaces, and a second curved side surface, the first flat side surface and the second flat side surface are paired and disposed in a face-to-face manner, the first curved side surface and the second curved side surface are paired and disposed in a face-to-face manner, a distance between the first flat side surface and the second flat side surface is substantially equal to the first width, and a distance between the first curved side surface and the second curved side surface is substantially equal to the second width.

18. The process cartridge according to claim 17, wherein the receiving portion is formed in a circular shape, and the receiving portion has a diameter greater than the width of the path and substantially equal to the second width of the fixing portion, and a curvature substantially equal to a curvature of each of the first and second curved side surfaces.

19. A process cartridge comprising:

a first frame;

an image holding member rotatably provided at the first frame;

a bearing member provided at the first frame, the bearing member including a shaft insertion portion through which the shaft is inserted, the bearing member having at least two protrusions;

a shaft that supports the image holding member, the shaft being supported by the bearing member; and a second frame having a receiving portion capable of receiving the bearing member and configured with holes corresponding to the protrusions on the bearing member, wherein the first frame and the bearing member sandwich the second frame when the first frame is assembled with the second frame such that the protrusions on the bearing member are biased against the second frame and fit in the corresponding holes in the second frame, and wherein the protrusions are located symmetrically with respect to the shaft insertion portion.

20. The process cartridge according to claim 19, wherein the first frame is removably attached to the second frame when the receiving portion receives the bearing member.

21. The process cartridge according to claim 20, wherein the bearing member includes a fixing device that is capable of fixing the first frame to the second frame when the bearing member is received by the receiving portion.

22. The process cartridge according to claim 19, further comprising a charging device provided at the first frame.

23. The process cartridge according to claim 22, further comprising a transfer device provided at the second frame.

24. The process cartridge according to claim 19, wherein the bearing member is provided separately from the first frame and the second frame.

* * * * *